US011149392B2

(12) United States Patent
Haaland et al.

(10) Patent No.: US 11,149,392 B2
(45) Date of Patent: Oct. 19, 2021

(54) PORTABLE WATER BARRIER

(71) Applicant: HAAWAL ENGINGEERING AS, Oslo (NO)

(72) Inventors: Kristian Vemund Haaland, Oslo (NO); Øystein Blix Walderhaug, Oslo (NO)

(73) Assignee: HAAWAL ENGINEERING AS, Oslo (NO)

( * ) Notice: Subject to any disclaimer, the term of this patent is extended or adjusted under 35 U.S.C. 154(b) by 0 days.

(21) Appl. No.: 16/771,035

(22) PCT Filed: Dec. 14, 2018

(86) PCT No.: PCT/EP2018/085004
§ 371 (c)(1),
(2) Date: Jun. 9, 2020

(87) PCT Pub. No.: WO2019/115787
PCT Pub. Date: Jun. 20, 2019

(65) Prior Publication Data

US 2021/0172136 A1 Jun. 10, 2021

(30) Foreign Application Priority Data

Dec. 15, 2017 (GB) ..... 1721041

(51) Int. Cl.
*E02B 3/10* (2006.01)

(52) U.S. Cl.
CPC ..... *E02B 3/106* (2013.01)

(58) Field of Classification Search
CPC ..... E02B 3/10; E02B 3/106; E06B 2009/007
See application file for complete search history.

(56) References Cited

U.S. PATENT DOCUMENTS 898,984 A 9/1908 McFarlane
5,605,416 A * 2/1997 Roach ..... E02B 3/02 405/21

(Continued)

FOREIGN PATENT DOCUMENTS

AU 2016203906 A1 1/2018
CN 104499460 A 4/2015

(Continued)

OTHER PUBLICATIONS

Notification of Transmittal of the International Search Report and Written Opinion (Form PCT/ISA/220), International Search Report (Form PCT/ISA/210), and Written Opinion (Form PCT/ISA/237) for International Application No. PCT/EP2018/085004 dated Mar. 14, 2019, 17 pages.

(Continued)

*Primary Examiner* — Benjamin F Fiorello
(74) *Attorney, Agent, or Firm* — Withrow & Terranova, P.L.L.C.; Vincent K. Gustafson

(57) ABSTRACT

A water barrier is formed from a kit of parts comprising at least one substantially water-impermeable membrane and a plurality of water-permeable panels that, when connected together, form a structural frame including a first part for supporting the at least one water-impermeable membrane against horizontal water pressure and a second part substantially perpendicular to the first part. A support structure may connect the first part and the second part to resist deflection of the frame. In an alternative arrangement, the frame of the water barrier may also be assembled in an inverted-V configuration.

33 Claims, 8 Drawing Sheets

(56) References Cited

U.S. PATENT DOCUMENTS

| | | | | |
|---|---|---|---|---|
| 6,079,904 | A * | 6/2000 | Trisl | E02B 3/106 405/107 |
| 6,132,140 | A * | 10/2000 | Kullberg | E02B 3/106 405/114 |
| 6,164,870 | A * | 12/2000 | Baruh | E02B 3/108 405/114 |
| 6,413,014 | B1 * | 7/2002 | Melin | E02D 29/025 405/107 |
| 6,672,799 | B2 * | 1/2004 | Earl | E02B 3/04 404/6 |
| 6,676,333 | B2 * | 1/2004 | Wiseman | E02B 3/106 405/114 |
| 6,692,188 | B1 * | 2/2004 | Walker | E02B 3/106 405/115 |
| 6,840,711 | B1 * | 1/2005 | Martinez | E02B 3/106 405/107 |
| 7,121,764 | B2 * | 10/2006 | Rorheim | E02B 3/106 405/107 |
| 7,172,176 | B1 * | 2/2007 | Eastland | E01F 13/022 256/26 |
| 8,434,967 | B2 * | 5/2013 | Nero | E02B 3/106 405/107 |
| 8,640,901 | B2 * | 2/2014 | Davis | B65D 90/023 220/1.6 |
| 9,120,619 | B2 * | 9/2015 | Hoopes | E02D 29/10 |
| 10,458,084 | B2 * | 10/2019 | Nero | F16M 11/22 |
| 2012/0121336 | A1 | 5/2012 | Arciszewski | |
| 2016/0289908 | A1 * | 10/2016 | Krogenes | E02B 3/106 |
| 2017/0204577 | A1 * | 7/2017 | Arrington | E02B 3/108 |
| 2019/0032293 | A1 * | 1/2019 | Fan | E06B 9/00 |

FOREIGN PATENT DOCUMENTS

| | | | |
|---|---|---|---|
| CN | 105324536 | A | 2/2016 |
| CN | 105756013 | A | 7/2016 |
| CZ | 12792 | U1 | 10/2002 |
| DE | 20218052 | U1 | 2/2003 |
| GB | 2347709 | A1 | 9/2000 |
| TW | M266309 | U | 6/2005 |
| WO | 9851865 | A1 | 11/1998 |
| WO | 02092918 | A1 | 11/2002 |
| WO | 2009103429 | A1 | 8/2009 |
| WO | 2017055079 | A1 | 4/2017 |

OTHER PUBLICATIONS

Search Report under Section 17(5) for United Kingdom Patent Application No. GB1721041.0 dated Jan. 23, 2018, 4 pages.

Search Report for Chinese Patent Application No. 2018800803976, dated Jun. 9, 2021, 4 pages including English machine translation.

* cited by examiner

PORTABLE WATER BARRIER

This application is a 35 U.S.C. § 371 national phase filing of International Application No. PCT/EP2018/085004 filed on Dec. 14, 2018, and claims the benefit of United Kingdom Patent Application No. 1721041.0 filed on Dec. 15, 2017, wherein the disclosures of the foregoing applications are hereby incorporated by reference herein in their respective entireties.

The present invention relates to a water barrier, particularly a re-usable, portable barrier for application as a flood barrier, and to a method for deploying such a barrier.

Flooding is one of the natural disasters that people are most likely to experience in their lifetimes.

Permanent flood defences are expensive, slow to install and must be installed well before any flooding occurs. Some methods of flood defence include planting vegetation to retain extra water, terracing hillsides to slow flow downhill, and the construction of floodways. Other techniques include the construction of water retention structures such as levees, lakes, dams, reservoirs and retention ponds to hold extra water during times of flooding.

However, even where such flood defences are employed, flooding can still occur. Prolonged rainfall, unusually high tides, fast snowmelt, or failure of water retention structures can make rivers rise and overtop their banks.

Flooding has many impacts. It damages property and endangers the lives of humans and other species. Rapid water runoff causes soil erosion and concomitant sediment deposition. The spawning grounds for fish and other wildlife habitats can become polluted or completely destroyed. Floods can interfere with drainage and economical use of lands, such as interfering with farming. Structural damage can occur in bridge abutments, bank lines, sewer lines, and other structures within floodways. Waterway navigation and hydroelectric power are often impaired.

Financial losses due to floods are typically millions of dollars each year, with the worst floods having cost billions of dollars.

Accordingly, a need exists for quickly deployable flood defence to protect structures and property against unexpected flooding. The most common solution for temporary flood protection is the sandbag. However, deploying sandbags requires substantial resources in terms of the sandbags themselves, as well as personnel and transport. Furthermore, sandbags absorb contaminants in the floodwater and after the flooding is over they must be disposed of properly and at great expense.

The present invention seeks to provide an improved, deployable water barrier.

Viewed from a first aspect, the present invention provides a water barrier comprising: a water-permeable frame; and a substantially water-impermeable membrane formed separately from the water-permeable frame, wherein the water-permeable frame is configured to support the water-impermeable membrane in an L-shape such that, in use, water pressure on an upper surface of a horizontal part of the frame counter-balances water pressure on a first surface of an upright part of the frame.

The present arrangement allows for a simple, compact design of water barrier. The weight of the water acting downwards on the horizontal part of the frame provides a moment around the rear edge of the frame, which counter-balances a moment generated by the horizontally-acting pressure from the water against the upright part of the frame.

In this arrangement, the frame and membrane may be transported separately to a flood site or similar and then quickly deployed. This arrangement reduces the amount of manual work required on site, as compared to some existing solutions, such as sandbags. This solution is also much more compact compared to sandbags, meaning that less material must be transported to the site.

Furthermore, in many cases, the barrier can be disassembled after use and at least parts of it may be re-used in the event of subsequent flooding, thus providing environmental and cost benefits compared to one-use solutions.

Another advantage of this arrangement is that it may be deployed even after flooding occurs or in moving water. In particular, the water-impermeable frame may permit water to flow past and through the frame as it is assembled. Then, once installed in place (and possibly anchored if required), the water-impermeable membrane can be deployed over the frame to create a flood barrier. This is particularly advantageous compared to many sandbag-alternative flood barrier solutions, which have struggled with this type of situation. Thus, this arrangement facilitates deployment at locations that might be difficult to protect using existing solutions, such as close the banks of a flooded river.

In this context, it will be appreciated that the water-impermeable barrier need not necessarily be entirely water impermeable, but should be sufficiently water-impermeable to prevent significant water egress past the barrier. That is to say, it is rarely necessary to provide complete dryness on the far side of the barrier, so long as the bulk of the water is retained. In this regard, it should be noted that flood barriers are often deployed on soil, which is not waterproof and so some degree of water will often be able to pass the barrier.

The water-impermeable membrane may sit on top of the water-permeable frame, when in use. Thus, the water weight may hold the water-impermeable membrane against the frame.

The water-impermeable membrane is preferably releasably fastened to the water-permeable frame. Whilst water weight may be sufficient in stationary water, moving water could disrupt the membrane, and so a direct attachment may be advantageous.

The membrane may extend horizontally beyond the horizontal part of the frame in the direction of the water, when in use. That is to say, the water-impermeable membrane may extend beyond an edge of the horizontal part opposite the upright part. Thus, the water-impermeable membrane may also form a seal against the ground, e.g. to prevent water passing under the frame.

The barrier may further comprise means for preventing the part of the membrane extending beyond the horizontal part of the frame from lifting. For example, the barrier may comprise a weight on the part of the membrane extending beyond the horizontal part of the frame. The weight may comprise one or more of sandbags or a length of chain. In other arrangements, the barrier may comprise an anchor or similar for attaching the part of the membrane extending beyond the horizontal part of the frame to the ground The membrane may comprise any suitable waterproof material. For example, the membrane may comprise a plastics material or a rubber material. The membrane may comprise a fibre-reinforced composite material, such as a fiber-reinforced plastics material.

The membrane may comprise a plurality of membrane sections, wherein the membrane sections are connected together in a substantially water-impermeable manner. For example, the membrane sections may overlap one another. In this case, weights or clamps may be used to prevent separation of the overlapping membrane sections.

The water-permeable frame may be formed from a plurality of panels. Each panel may be a rigid panel. Each panel may be a discrete panel. That is to say, each panel is preferably not permanently attached to another panel. For example, the panels may be connected or connectable together in a manner so as to be separable from one another without the need for tools (after any support structures have been removed). The panels are preferably not connected together via a hinge or similar joint.

The panels may be configured to be fastened together, preferably in a releasable manner. That is to say, such that they can be attached and released without damaging the panels, e.g. such that they can be subsequently re-attached.

The plurality of panels may comprise a plurality of perforated panels. The perforations may account for at least 50% of a surface area of each perforated panel, and preferably at least 75% and more preferably at least 80% of a surface area of each perforated panel. Thus, water can easily flow through the panels.

In one example, the perforated panels may comprise a grating structure. For example, the grating structure may comprise a plurality of intersecting bars, which preferably intersect at approximately right angles.

The plurality of panels may comprise a plurality of wall panels and a plurality of floor panels. When deployed, the water-impermeable membrane may extend across at least two floor panels.

The wall panels and the floor panels may be substantially equal in size. In some embodiments, the wall panels and the floor panels may be used interchangeably. For example, the wall panels and the floor panels may be substantially identical in form.

The wall panels and the floor panels may be configured to connect together to form an L-shaped structure. For example, the wall panels and the floor panels may be configured to connect together at approximately 90°, for example ±20°, or more preferably ±10°, and most preferably ±5°.

At least the wall panels may each comprise at least one connection element for connection to a respective floor panel. There may be arrangements in which the at least one connection element permits connection of the respective wall panel to an edge of the respective floor panel. However, preferably, the at least one connection element permits connection of the respective wall panel to a face of the respective floor panel.

The at least one connection element may permit connection of the respective wall panel at multiple locations on the face of the respective floor panel. This may permit the wall panel to be connected at different positions in the forward-backward direction along the floor panel, e.g. so as to vary how much of the floor panel is in front of and behind the wall panel.

The at least one connection element may permit connection of the respective wall panels to the respective floor panel facing in at least two different directions with respect the respective floor panel. The at least two direction are preferably not 180° apart, i.e. simply changing which direction the panel faces. In one arrangement, the two directions are 90° apart (e.g. ±10°, preferably ±5°).

The at least one connection element may comprise a plurality of protrusions. Where the panel comprises a grating structure, the protrusions may be formed by omitting a final edge of the grating structure. Alternatively, the protrusions may be formed in other manners.

At least the floor panels may each comprise a plurality of apertures sized to receive the plurality of protrusions. For example, the plurality of apertures for receiving the protrusions may be provided by the perforations where the panels are perforated panels.

The plurality of apertures may be arranged in a grid configuration, for example, where the panels have a grating structure, the holes in the grating structure may provide the apertures.

The plurality of apertures may permit two or more wall panels to connect to a single floor panel. The two or more walls may be permitted to connect in different orientations, for example 90° different.

Each wall panel may be rectangular, and may have a length that is longer than its width, both of which may be longer than a thickness of the panel.

Then, each wall panel may comprise at least one connection element formed along a first edge where the first edge extends in the width-wise direction, and at least one connection element formed along a second edge where the second edge extends in the length-wise direction. This arrangement allows the wall panels to be connected to the floor panels in two vertical orientations, i.e. a portrait orientation and a landscape orientation. Thus, two heights of barrier can be established using a single type of panel providing greater flexibility in how the barrier can be deployed.

The barrier may further comprise a support extending from the horizontal part of the frame to the upright part of the frame to resist deflection of the upright part of the frame.

The support structure may be configured to carry tension, and in some embodiments the support structure may be configured to only carry tension.

The support structure may comprise a cable.

In some arrangements, the support structure may comprise a rigid component, such as a bar, and optionally a telescopic bar. Optionally, the support structure may comprise a combination of a rigid component and a cable.

The support structure may extend over an upper edge of the upright part. The support structure may trap the waterproof membrane between support structure and the upper edge of the upright part of the frame. Thus, the support structure may both support the structure of the frame as well as retaining the waterproofing in place.

The support structure may be connected to a second surface of the upright part, opposite the first surface of the upright part.

The support structure may be attached to the upright part by at least one connector.

The (or each) connector may be configured to connect at multiple locations on the second surface. For example, in the case of a frame having perforations, such as perforated panel, e.g. with a grating structure, the connector may be configured to engage at least one perforation of the panel.

The connector may be configured to permit detachment when the support structure is un-tensioned, but prevent detachment when tension is applied to the support structure. The connector may comprise a hook.

The support structure may be connected to an attachment point on the horizontal part, which may be formed on the upper surface of the horizontal part. The attachment point may clamp the waterproof membrane against the horizontal part.

The attachment point may comprise a clamp part for engaging the horizontal part of the frame. The attachment point may further comprise an attachment part configured to engage with the clamp part and permit attachment to the support structure.

The waterproof membrane is trapped between the attachment part and the clamp part. The engagement between the attachment part and the clamp part may form a water-tight seal against the waterproof membrane. Optionally, at least one of the attachment part and the clamp part is provided with a gasket to facilitate the water-tight seal.

The support structure may comprise a tensioning mechanism for applying tension to the support structure.

Where the support structure is a cable, the cable may be connected to the second surface of the upright part at two locations, and the cable may be connected to the attachment point on the horizontal part at a point between the two locations. One or both of the two locations where the cable is connected to the upright part may be at an end of the cable. Where a tensioning mechanism is present, the tensioning mechanism may comprise a mechanism to pull together the two parts of the cable on either side of the attachment point.

The water-permeable frame may be composed of a plurality of L-shaped modules, each comprising a wall part and a floor part. Each module may comprise a support structure as described above. Each L-shaped module is formed from at least two panels, where each panel may be the panels as described above, and may include any one or more of the optional features described above.

The barrier may further comprise an anchor for attaching the frame to the ground. The anchor preferably attaches the horizontal part of the barrier to the ground.

The barrier may comprise braces extending from a second side of the upright part to support the barrier.

The barrier may have a height of at least 50 cm, and preferably at least 100 cm.

The water barrier is preferably a non-permanent structure. For example, the water barrier may be assemblable from a kit of parts in less than 24 hours and/or may be disassemblable into a kit of parts in less than 24 hours.

The water barrier may be deployable in water, and preferably in moving water.

The water barrier may be deployable by hand and/or without the aid of machinery.

Viewed from a second aspect, the present invention provides a water barrier comprising: a water-permeable frame composed of one or more water-permeable forward panels and one or more water-permeable rearward panels, the panels being arranged to form an inverted-V shape; and a substantially water-impermeable membrane formed separately from the water-permeable frame, wherein the water-permeable frame is configured to support the water-impermeable membrane in a shape having a horizontal portion and a sloped portion that slopes upwardly from the horizontal portion, such that the sloped portion of the water-permeable membrane is supported by the one or more forward panels.

Each panel may be a discrete panel. That is to say, each panel is preferably not permanently attached to another panel. For example, the panels may be connected or connectable together in a manner so as to be separable from one another without the need for tools (after any support structures have been removed). The panels are preferably not connected together via a hinge or similar joint.

The panels may each comprise a grating structure.

The forward panels and the rearward panels may be configured to connect together at approximately 90° (for example ±20°, or more preferably ±10°, and most preferably ±5°). This arrangement may form an L-shaped structure or a T-shaped structure.

At least each of the rearward panels (optionally each of the panels) may comprise at least one connection element for connection to a respective forward panel. Optionally, each of the panels may comprise at least one connection element for connection to a respective panel.

The at least one connection element may permit connection of the respective rearward panel to the forward panel at multiple locations on the face of the forward panel.

The at least one connection element may comprise a plurality of protrusions. At least each of the forward panels (optionally each of the panels) may comprise a plurality of apertures sized to receive the plurality of protrusions.

The plurality of apertures may permit two or more (rearward) panels to connect to a single (forward) panel.

The forward panels and the rearward panels may be usable interchangeably with one another.

The barrier may further comprise a support extending between the forward part to the rearward part to resist deflection of the forward part of the frame.

The water barrier may be deployable in moving water by hand and/or without the aid of machinery.

The water barrier may optionally include any one or more or all of the preferred features of the water barrier of the first aspect, insofar as they are compatible. For example, features relating to the L-shaped frame of the first aspect may apply to the inverted-V-shaped barrier of the second aspect, when rotated accordingly. In one arrangement, panels forming the horizontal part and the upright part in the first aspect may, respectively, provide the rearward panels and the forward panels in the second aspect.

Viewed from a third aspect, the present invention also provides a kit of parts for assembling a water barrier.

The kit of parts may comprise at least one water-impermeable membrane.

The kit of parts may comprise at least two water-permeable panels that, when connected together, form a structural frame. The structural frame may have a substantially L-shaped cross-section or a substantially T-shaped cross-section.

Each panel may be a discrete panel. That is to say, each panel is preferably not permanently attached to another panel. For example, the panels may be connected or connectable together in a manner so as to be separable from one another without the need for tools (after any support structures have been removed). The panels are preferably not connected together via a hinge or similar joint.

The structural frame may include a first part and a second part. The first part and the second part may be substantially perpendicular, when assembled. At least one of the panels may form the first part and at least one of the panels may form the second part. The structural frame may be suitable for supporting the at least one water-impermeable membrane, e.g. against horizontal water pressure.

The kit of parts may comprise at least one support structure for connecting the horizontal part to the upright part to resist deflection of a part of the frame, which may be a part resisting horizontal water pressure.

The panels may each comprise a grating structure.

At least one of the panels, optionally each of the panels, may comprise at least one connection element for connection to another of the panels in a substantially perpendicular manner.

The at least one connection element may permit connection of the respective panel to another panel at multiple locations on the face of the other panel and/or facing in at least two different directions with respect to the other panel.

The at least one connection element may comprise a plurality of protrusions. At least one other panel, optionally each panel, may comprise a plurality of apertures sized to receive the plurality of protrusions. The plurality of apertures may permit two or more other panels to connect to the respective panel.

Each of the panels may be usable interchangeably with every other one of the panels.

The support structure may be configured to, in use, extend over an edge of the first part and may trap the or at least one of the waterproof membrane(s) between the support structure and the edge of the first part of the frame.

The kit of parts may further comprise at least one attachment point for connection of the support structure to one of the panels. The attachment point may be configured to, in use, clamp the waterproof membrane against the panel.

The support structure may comprise a tensioning mechanism for applying tension to the support structure.

The kit of parts may be arranged so as to be deployable in moving water by hand and/or without the aid of machinery.

The kit of parts may be for assembling a water barrier as described above in either the first or second aspect. Thus, the kit of parts may comprise components that, when assembled, provide any one or more or all of the optional features and/or functions thereof. In respect of the first aspect, the first part may be the upright part and second part may be the horizontal part. The at least two panels may comprise the optional plurality of panels of the water barrier of the first aspect. In respect of the second aspect, the at least two panels may comprise the forward panels and the rearward panels.

Viewed from a fourth aspect, the present invention provides a method of assembling a water barrier from a kit of parts as described above. The method may comprise: connecting the water-permeable panels to form a water-permeable frame having a first part for supporting the water-impermeable membrane against horizontal water pressure and a second part substantially perpendicular to the first part; and covering the water-permeable frame with the water-impermeable membrane, such that the water-permeable frame supports the water-impermeable membrane.

The step of providing a water-permeable frame may comprise connecting a first water-permeable panel to a second water-permeable panel. Connecting the first water-permeable panel to a second water-permeable panel may form a water-permeable frame module. The method may comprise assembling a plurality of water-permeable frame modules to form the water-permeable frame, which may be performed before the step of covering the water-permeable frame with the substantially water-impermeable membrane.

The method may further comprise connecting the support structure between the first part and the second part. Connecting the support structure may be performed before or after the step of covering the water-permeable frame with the substantially water-impermeable membrane.

The frame may support the substantially water-impermeable membrane in an L-shape. For example, such that water pressure on an upper surface of the second part of the frame counter-balances water pressure on a first surface of the first part of the frame.

The method may further comprise connecting a support structure to a second surface of the upright part, opposite the first surface, and connecting the support structure to an attachment point on the horizontal part, such that the support structure extends over an upper edge of the upright part and traps the waterproof membrane between the support structure and the upper edge of the upright part of the frame.

In another arrangement, the frame may support the water-impermeable membrane in a shape having a horizontal portion and a sloped portion that slopes upwardly from the horizontal portion, such that the sloped portion of the water-permeable membrane is supported by the first part of the frame.

The method may comprise connecting a clamp part of an attachment point to the frame before the step of covering the water-permeable frame with the substantially water-impermeable membrane. The method may comprise connecting the substantially water-impermeable membrane to the attachment point.

The attachment point may comprise a projection that extends through the substantially water-impermeable membrane.

The method may comprise trapping the substantially water-impermeable membrane between an attachment part of the attachment point and the clamp part of the attachment part.

The method may comprise connecting the support structure to the attachment point, and preferably to the attachment part of the attachment point.

The step of covering the water-permeable frame with a substantially water-impermeable membrane is performed whilst the water-permeable frame is at least partially submerged in water.

The water barrier may be a water barrier as described above in the first or second aspect, optionally including any one or more or all of the preferred features thereof.

Certain preferred embodiments of the present invention will now be described in greater detail by way of example only and with reference to the accompanying drawings, in which.

Figure 1:
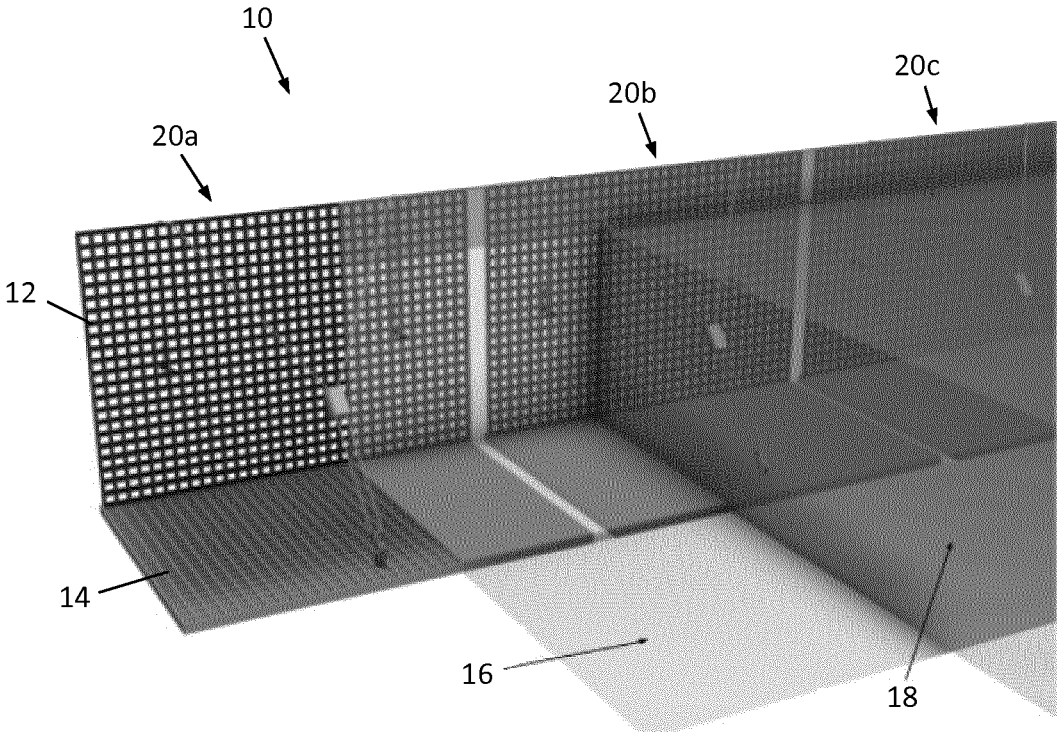
FIG. 1 is a cut-away perspective view showing a deployable flood barrier.
Figure 17:
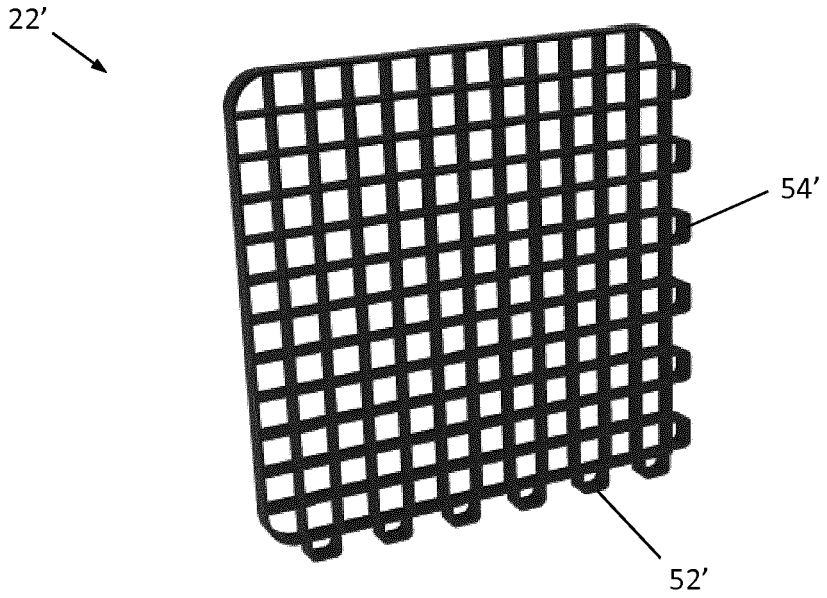
Figure 18:
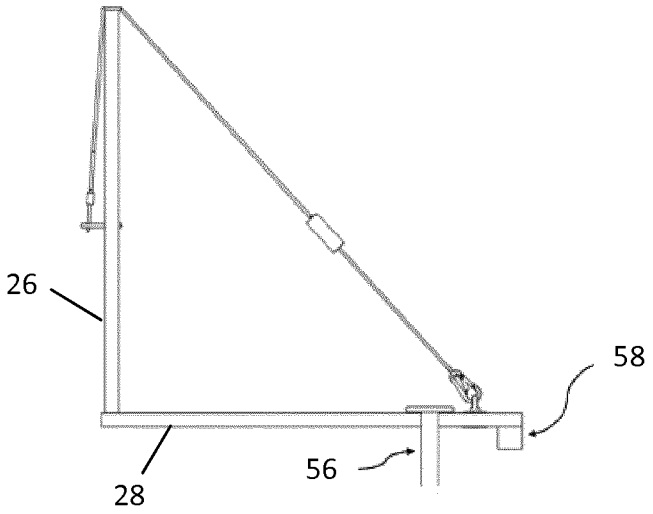
Figure 19:
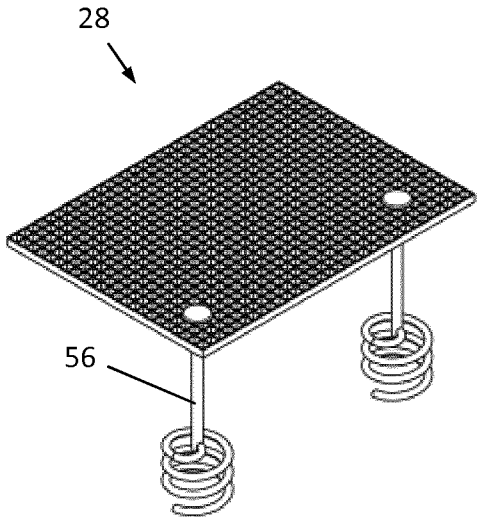
Figure 20:
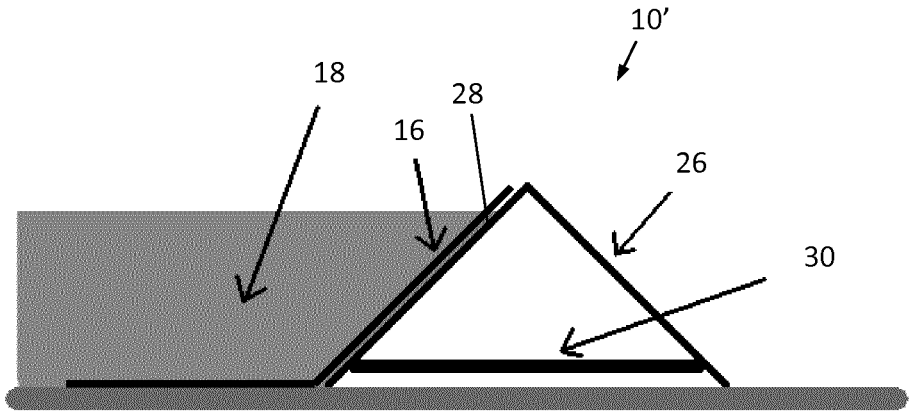
Figure 21:
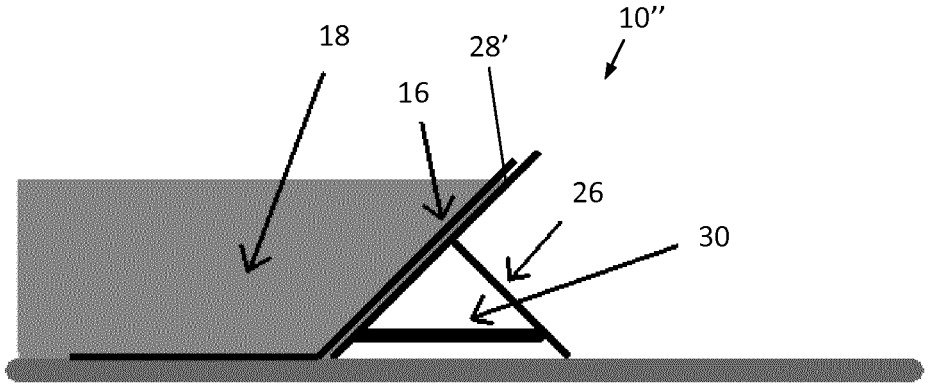

FIG. 17 illustrates an alternative design for the panel of the structural frame; and FIGS. 18 and 19 illustrate anchors for connection of the structural module to the ground; and FIGS. 20 and 21 illustrate alternative arrangements for the flood barrier FIG. 1 illustrates a modular, portable, flood barrier 10 which may be assembled on-site, i.e. within close proximity to or at the location where it is to be deployed to provide flood protection.

The barrier 10 is generally L-shaped in cross section, i.e. having a base part 14 and an upright part 12. In use, the base part 14 of the barrier 10 points into the flood water 18. The weight of the flood water 18 presses onto the base part 14 of the barrier 10 to stabilize it, thereby causing the upright part 12 to create a barrier which stops the water 18.

The barrier 10 comprises two main elements. The first is a skeleton, e.g. composed of a plurality of structural modules 20*a*, 20*b*, 20*c*. The second is a waterproof membrane 16 covering the skeleton, which in the FIG. 1 arrangement is in the form of a thin, flexible, waterproof sheet or membrane 16. The skeleton gives the barrier 10 its structural integrity and resists the forces associated with the flood water 18, while the waterproof membrane 16 stops the flood water 18 from passing through the skeleton.

Figure 2:
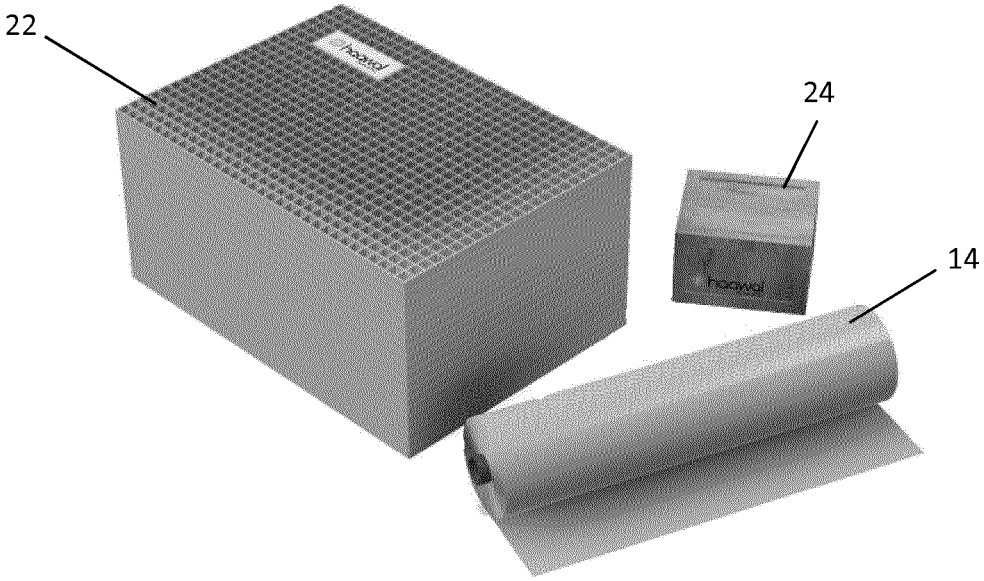
FIG. 2 is a perspective view of a kit of parts for assembling the deployable flood barrier.

As will be discussed in greater detail later, the various different components of the barrier 10 can be taken apart, i.e. they are discrete components. Thus, the barrier 10 may be supplied or stored as a kit of parts, such as shown in FIG. 2, comprising a plurality of panels 22 for forming the structural modules 20*a*, 20*b*, 20*c*, the waterproof membrane 14, and optional fasteners 24 as will be discussed below.

The kit of parts is much more compact than the assembled barrier 10, simplifying both storage of the barrier 10, as well as transportation of the barrier 10 to a flood location. Furthermore, the absence of complicated or fragile parts allows for storage and deployment of the barrier 10 in harsh conditions.

The waterproof membrane 16 may comprise any waterproof material that ensures that the barrier 10 is waterproof. It may, for example, comprise a uniform (non-reinforced) material, such as plastic, or a fibre-reinforced composite material. Different materials can be used to cover different needs. For example, a stronger, reinforced membrane may be useful for fast moving floods that could contain debris, while a cheaper plastic membrane can be used for calmer floods.

The material used for the waterproof membrane 16 may also be chosen to be of a recyclable material, and/or may be chosen to fit storage requirements such that it can be stored in sealed packaging for long periods of time whilst retaining functionality.

The waterproof membrane 16 is illustrated in this arrangement as extending beyond the front of the base 14. Where it extends beyond the front of the base 14, the waterproof membrane 16 is preferably held in place using a weight, such as a heavy chain or a row of sandbags (not shown), to ensure a good seal against the ground. Alternatively, the edge of the membrane may be anchored to the ground in some other manner. Once held in place by the weight of the water, the seal between the membrane and the ground will be relatively robust.

The waterproof membrane 16 can be made out of several smaller lengths that are made waterproof by overlapping them, and if needed secured by for example tape or glue. The overlap can also or alternatively be secured by weighting the membrane 16 at the overlap above the base 14 to secure placement and ensure waterproofing.

Figure 3:
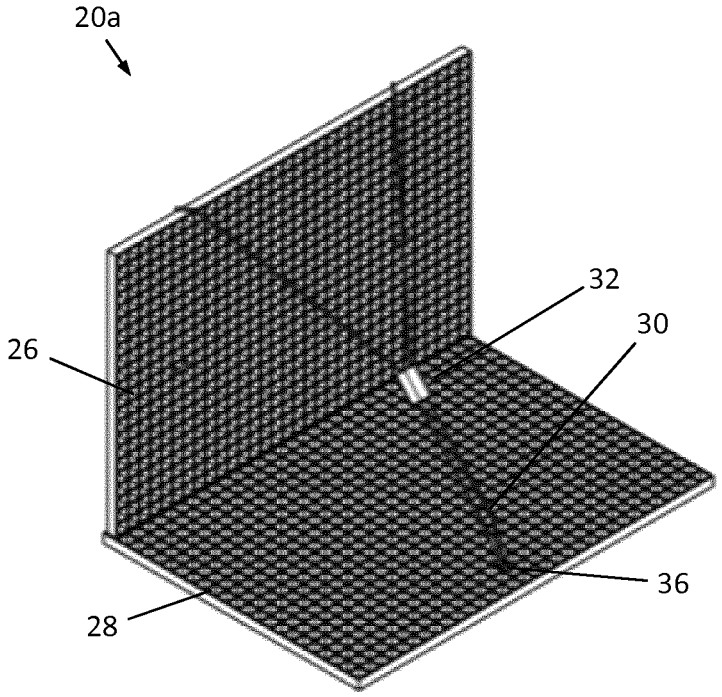
FIG. 3 is a perspective view of a structural module of the deployable flood barrier.
Figure 4:
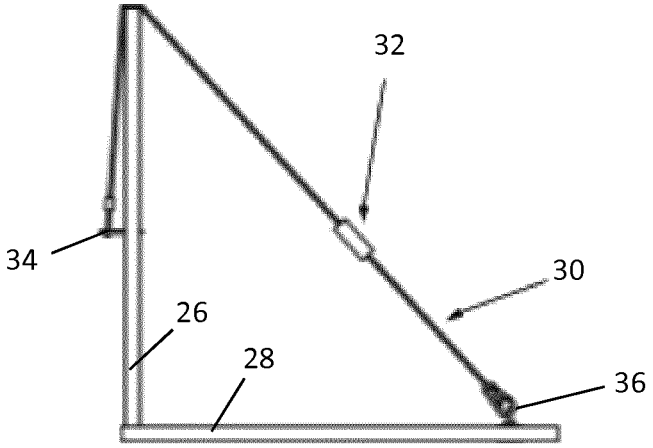
FIG. 4 is a side view of the structural module.
Figure 5:
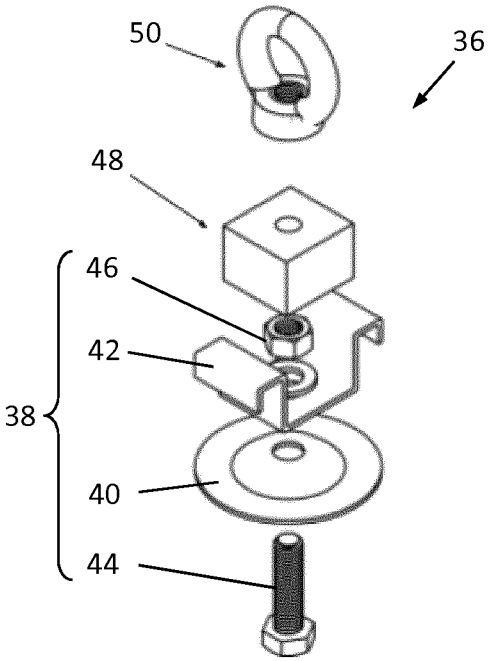
FIGS. 5 and 6 illustrate an attachment ring being connected to the structural module.

In the FIG. 1 arrangement, each of the structural modules 20*a*, 20*b*, 20*c* forming the skeleton are of an identical configuration. One of the modules 20*a* is shown in isolation in FIGS. 3 and 4, and will now be described in greater detail.

The structural module 20*a* comprises two rectangular panels 22. Each rectangular panel 22 is formed of a grating material. The two panels 22 combine together to create the wall 26 and the base 28 of the module 20*a*, respectively.

An advantage of the use of grating material is that the module 20*a* can be easily positioned and erected in moving water, which is something that is challenging with existing systems. The holes in the plates 22 allow flood water 18 to pass through the plates 22 during deployment without exerting a large force. For example, the voids in the plates 22 might typically be expected to account for at least 80% of its surface area.

Optionally, a wire 30 can be used to connect the wall 26 and base 28 to further strengthen the structural module 20*a*. The wire 30 and its attachment point 36 may also help to keep the waterproof membrane 16 in place. That is to say, the wire 30 may act as both a strengthening element of the barrier 10 and an attachment point for the waterproof membrane 16.

In the illustrated arrangement, a single wire 30 is connected at its two ends to a rear face of the wall 26 of the module (i.e. the side opposite to the base 28) and at a midpoint to the base 28 such that the wire runs over the top of the wall 26. In this arrangement, the wire 30 provides resistance against the wall 26 tipping backwards (away from the base 28) due to the pressure of the flood water 18.

A method of installing the wire 30 will now be described with reference to FIGS. 5 to 10.

Firstly, in advance of erecting the barrier 10, a connection point 36 is mounted onto a panel 22 that will form the base 28 of the module 20*a*. The attachment point 36 is shown in exploded form in FIG. 5. The clamp part 38 of the attachment point 36 is attached on the grating 28, and includes a lower clamp member 40, an upper clamp member 42, and a threaded rod 44 (or bolt) that points upward from the base 28. A nut 46 is threaded onto the threaded rod 44 to clamp the grating of the panel 22 between the clamp members 40, 42.

Figure 6:
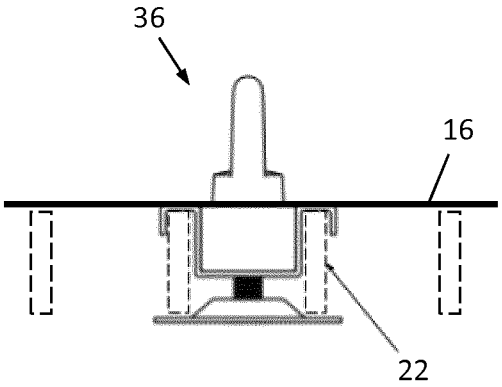

Once the module 20*a* is assembled, a gasket 48 is fitted over the threaded rod 44 to form a seal surface at or above the surface of the panel 22. Next, the waterproof membrane 16 is placed over the module 20*a* and a hole in the waterproof membrane 16 in pulled down over the rod 44 (or alternatively the waterproof membrane 16 may be punctured by the rod 44), leaving the end of the rod 44 exposed over the waterproof membrane 16. A lifting eye 50 (or any other attachment member suitable for connection to the wire 30) is then attached to the threaded rod 44, e.g. screwed onto the threaded rod 44, over the waterproof membrane 16. As shown in FIG. 6, the gasket 48 thus seals the hole in the waterproof membrane 16 utilizing pressure gained from mounting the lifting eye 50.

It will be appreciated that the above the clamp part 38 is merely one example of how the lifting eye 50 can be attached to the base 28.

Furthermore, whilst the exemplary rod 44 penetrates upwards through the waterproof membrane 14 for connection to the lifting eye 50, it will be appreciated that the rod 44 could be installed downwardly through the waterproof membrane 14 from above, e.g. by being integral with or otherwise coupled to the lifting eye 50.

Next, the wire 30 is attached to the module 22*a*. The wire 30 exploits the grating of the panels 22 to permit quick and easy attachment at any point on the module 20*a*. This is important as different configurations of the wall 26 and base 28, as will be discussed later, may have different lengths between the attachment point 36 and the top of the module 20*a*. This can be easily adjusted by attaching the wire ends further up or down the wall 26.

Figure 7:
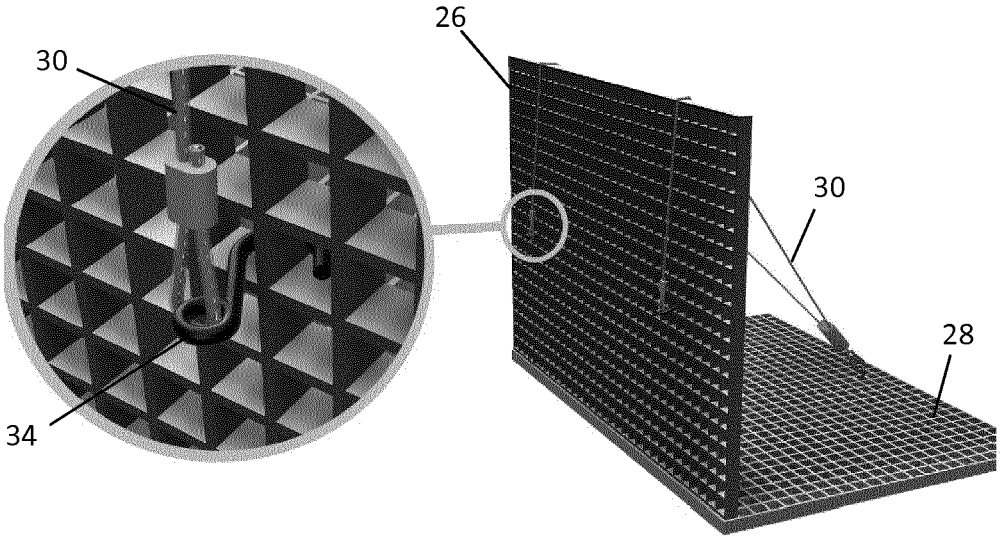
FIG. 7 illustrates an attachment hook for connecting an end of a wire to the structural module.

As shown in FIG. 7, to facilitate connection of the ends of the wire 30 to the module 20*a*, a hook 34 is connected to each end of the wire 30. Each hook 34 is used to securely attach the wire 30 to a location on the wall 26. It will be appreciated that the hook may take any form suitable for mechanically engaging with the wall 26 to provide an anchor point.

Figure 8:
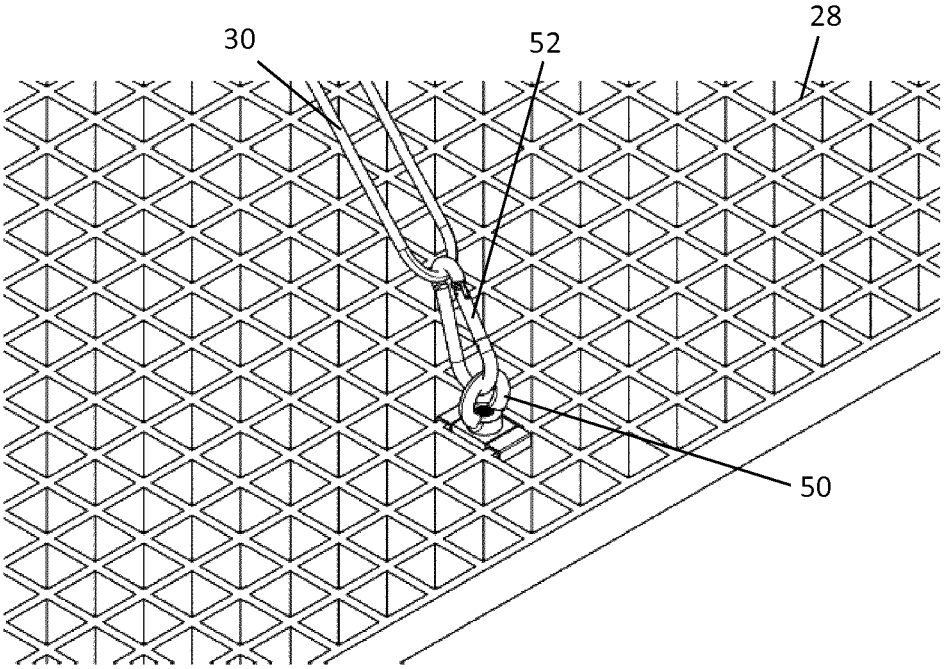
FIG. 8 illustrates attachment of a midpoint of the wire to the attachment ring.

The middle of the wire 30 is then run over the top of the wall 26, where it helps secure the waterproof membrane 16 in place by pressing against the top of the module 20*a*. As shown in FIG. 8, the midpoint of the wire 22*a* is connected to the lifting eye 50, for example with a carabiner 52 or similar fastening mechanism. Alternatively, the wire 22*a* may be connected to the lifting eye by passing directly through the lifting eye 50.

Thus, when deploying the barrier 10, the wire 30 can be quickly attached to provide both structural support for the module 20*a* and to hold the waterproof membrane 16 in place.

It is advantageous that the wire 30 is free of tension when mounting it to the connection points to facilitate easy assembly. Thus, a mechanism may optionally be provided to tighten the wire 30 after assembly to remove any slack in the wire 30. After the module 20*a* is assembled, tensioning the wire 30 allows the hooks 34 to be securely fastened to the wall 26, locks the waterproof membrane 16 in place, and secures the connection between the wall 26 and the base 28. The tightening mechanism also allows for flexibility when choosing connection points as any slack can be removed when tightening.

Figure 9:
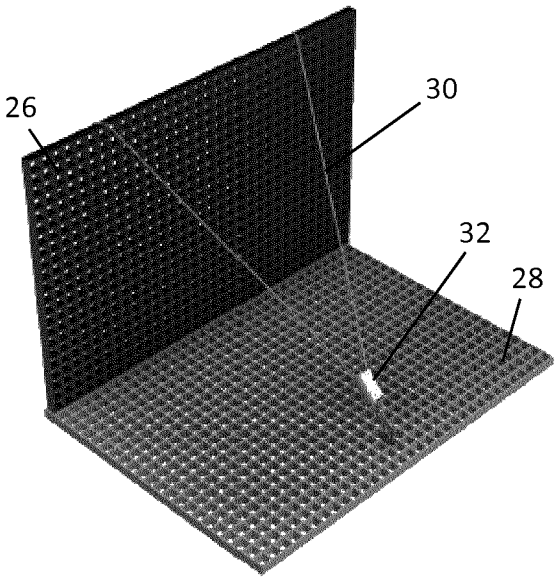
FIGS. 9 and 10 are perspective views of the structural module illustrating operation of a wire tensioning mechanism.
Figure 10:
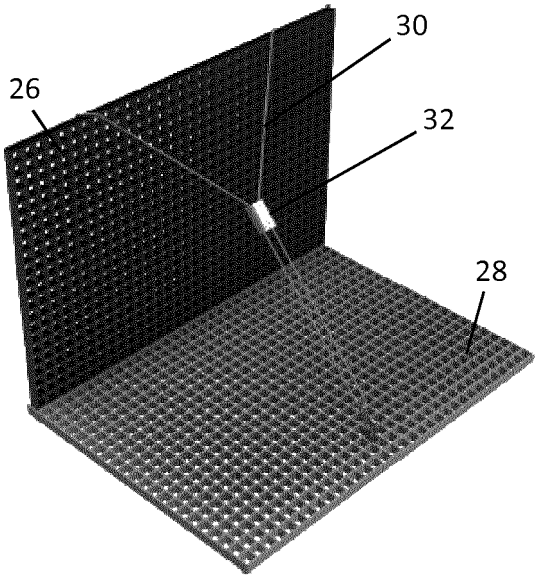

The operation of the tightening mechanism is illustrated in FIGS. 9 and 10. The tightening mechanism works by pulling a sliding part 32, connected to the wire 30 on both sides of the lifting ring 50/carabiner 52, upwards from the base pulling the lengths of wire together and consequently tightening the wire 30 by reducing the effective length of the wire by up to 25%. There are many different alternatives to a tightening mechanism that can be used, but the basic function of increasing the tension should remain the same.

For clarity, the waterproof membrane 16 is omitted in FIGS. 9 and 10. However, it will be appreciated that the tightening mechanism would normally be actuated after installation of the waterproof membrane 16.

Figure 11:
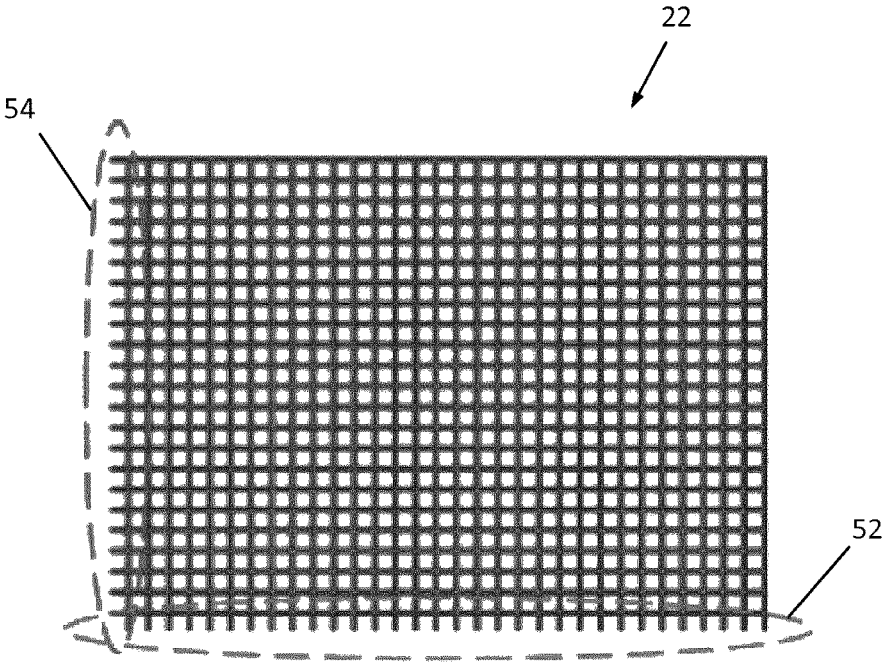
FIG. 11 illustrates attachment points of a panel of the structural module.

As discussed previously, the panels 22 forming the wall 26 and base 28 of the module 20*a* are made of a grating material. To facilitate attachment between panels 22, the edge of the grating may be removed creating a row of protrusions in the form of "pegs" 52 (circled in FIG. 11) that can be placed onto the base 28 at any desired place. This allows flexibility in the different configurations that can be achieved by placing the wall at different positions on the base.

Figure 12:
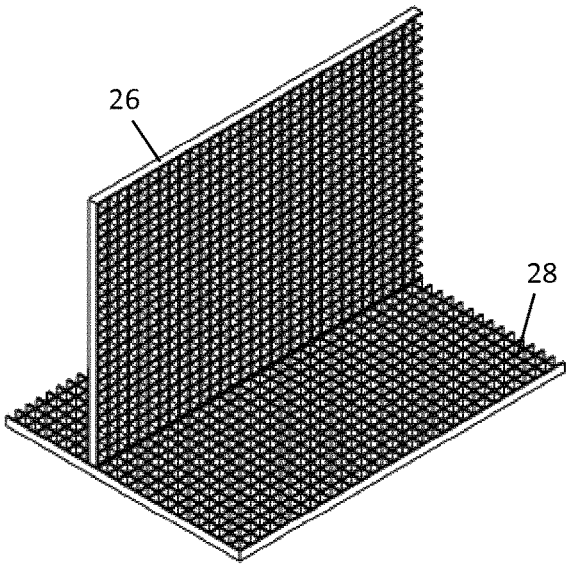
FIGS. 12 to 16 illustrate alternative arrangements for connection of two or more panels to form different configurations.

This arrangement allows the wall 26 to be moved backwards and forward along the base 28, as illustrated in FIG. 12. For example, this may allow a continuous wall to be constructed, even where there are obstructions.

Figure 13:
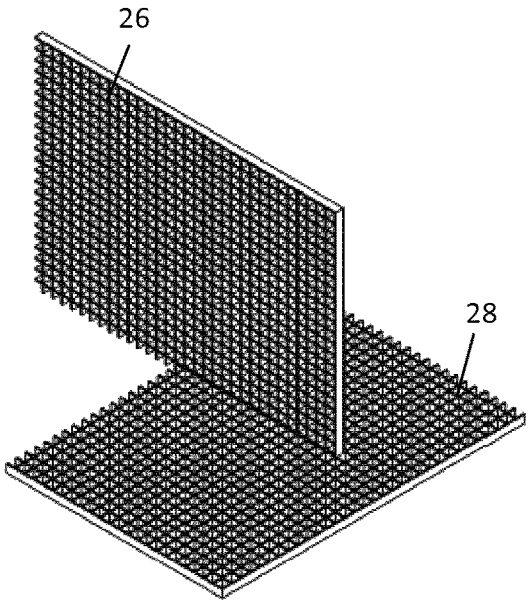

Also, as shown in FIG. 13, the use of a grating having square holes in fact allows for the wall 26 to be connected to the base 28 in a different direction/orientation. The wall 26 then extends to the side of the base 28, and so can be connected to the following base 26 creating a connection point between modules 20 mounted next to each other which can further strengthen the barrier 10. This is, of course, not required for the system to work, but is especially useful when creating a perimeter around an object that you wish to protect from the flood.

Figure 14:
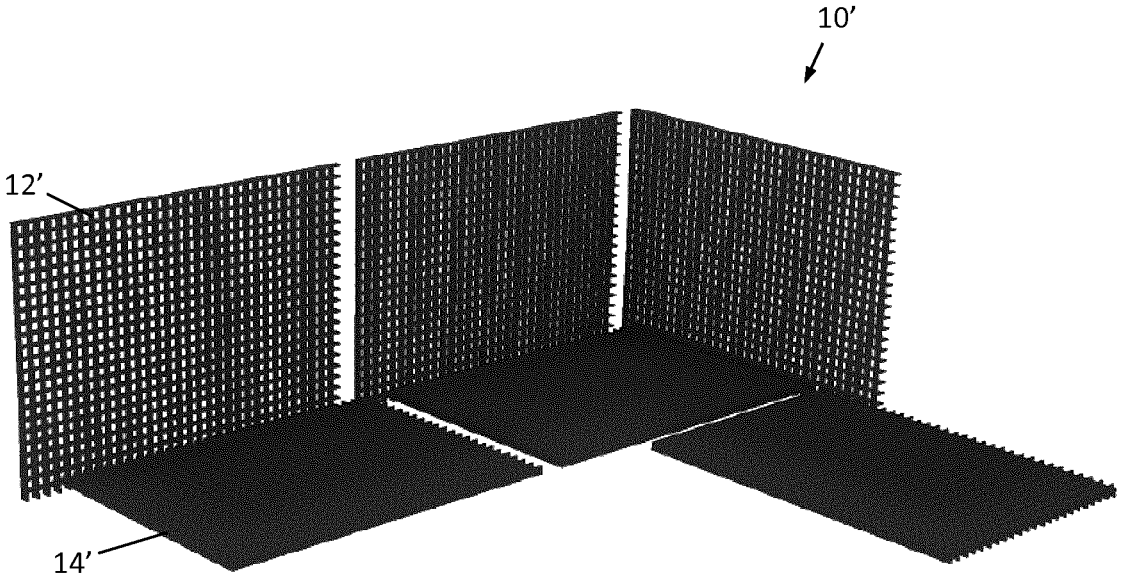

Additionally, the ability to connect the wall 26 at a different angle is useful to turn corners, as shown in FIG. 14. In this arrangement, a second wall 26 can also easily be attached to a single base 28 to create a 90 degree angle at any point. In this arrangement, the barrier 10' may not be constructed from pre-constructed modules 20, but rather the upright part 12' and the base part 14' of the skeleton are assembled in situ directly from the panels 22. Wires 30 and the waterproof membrane 16 may then be connected in the same manner as discussed above.

Whilst the above technique can be used for creating angles of 90 degrees, it should be appreciated that smaller angles can be created by angling each module 20*a*, 20*b*, 20*c* individually in relation to each other. The barrier 10 will still remain waterproof after being draped with the waterproof membrane 16. The curvature that can be achieved in this way is dependent on the strength of the waterproof membrane 16, as the larger the angle, the larger the force on the unsupported section of the membrane (between two modules) becomes. Optionally, connectors may be attached between adjacent modules 20 to provide support to the waterproof membrane 16, such as cables or rigid braces.

Returning to FIG. 11, a second set of protrusions in the form of "pegs" 54 may be formed on one of the shorter sides in addition to those pegs 52 formed on one of the longer sides. This allows for two different height configurations, as illustrated in FIGS. 12 and 13, respectively, depending on whether the longer end or the short end becomes the width of the module. This means that a single system can be set up in two different ways to protect against two different depths of floods.

As noted above, the same panels 22 may be used for both the walls 26 and the base 28 to facilitate simpler assembly. Thus, the panels 22 used for the base 28 may similarly comprise protrusions, e.g. in the form of pins 52, 54, that are simply not used.

In an alternative arrangement, two sets of panels may be provided, one having pins 52 on the longer side and the other having pins 54 on the shorter side. Then, when assembling the modules 20, the appropriate panels 22 may be selected for the desired height of module 20.

Whilst a particular design of grating has been illustrated for the panels 22, it should be appreciated that the panels 22 are not limited to this design. FIG. 17 shows an alternative grating for a panel 22'. The grating used for panel 22' again comprises an array of squares. However, in this example, the protrusions 52', 54' are larger and more rounded. The system would otherwise function in the exact same way as the panels 22 described above.

In further embodiments, a mesh of other repeating geometries is also possible, for example a honeycomb structure. There are also many possibilities that can be made with a custom mould allowing for more intricate protrusions/pegs. In further embodiments, the panels may, for example, comprise sheets with circular cut-outs forming the holes and having cylindrical protrusions/pegs.

With reference to FIGS. 18 and 19, in some scenarios anchoring of the barrier 10 can be advantageous to improve the stability of the barrier 10. An exemplary anchor 56 is shown comprising a helical screw design. However, the design of the anchors will vary depending on the type of foundation. For example, in some embodiments, pile-type anchors could be used. The anchors 56 can be installed when erecting the barrier 10 or may be pre-attached to the base panels 28.

The use of grating for the panel 22 allows an anchor 56 to easily be placed at any desired point on the base 28. In some embodiment, it is possible to utilize the down force created from anchoring in combination with a gasket 58 to provide sealing against the foundation which the barrier 10 is erected on.

If anchoring is used only for improving the stability, the anchor 56 can be mounted in advance of the waterproof membrane 16 and would therefore not affect the waterproofing of the barrier 10.

If anchoring is used with a gasket, the membrane would be placed over the barrier 10 before anchoring. A continuous gasket 58 would then be placed under the front of the base. After the gasket is placed anchors would be mounted through the waterproof membrane 16 and sealed against the membrane with a seal material. Gaskets 58 can be used in combination with an extended waterproof membrane 16 to form a skirt.

Whilst the above embodiment illustrates the flood barrier 10 deployed in an upright L-shaped configuration, the flood barrier 10 may also be deployed in a Δ-shaped (delta-shaped) or inverted-V-shaped configuration as shown in FIGS. 20 and 21.

In FIG. 20, a barrier 10' is again assembled of a plurality of modules 20*a*, 20*b*, 20*c*, similar to those used to assemble the barrier 10 shown in FIG. 1. However, when assembling the Δ-shaped barrier 10', each L-shaped module 20*a*, 20*b*, 20*c* is oriented with its apex directed generally upwards. For example, as illustrated in FIG. 20, the base 28 (forward panel in this arrangement) is directed towards with flood water 18 with the wall 26 (rear panel in this arrangement) directed away from the flood water 18. Consequently, the waterproof membrane 16 is laid over the forward panel 28 to prevent ingress of the flood water 18.

Figure 15:
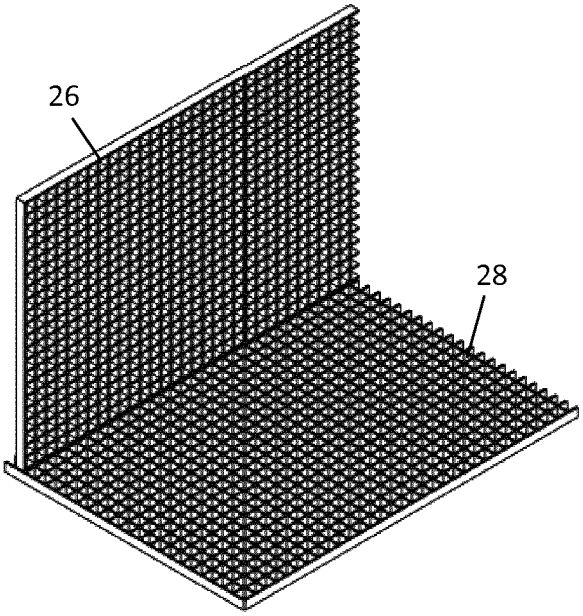
Figure 16:
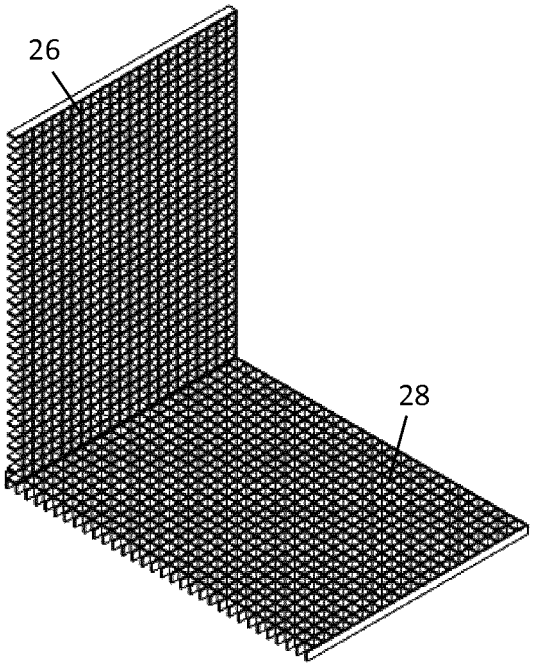

As in the preceding embodiments, the modules 20*a* may be assembled in two different configurations (see FIGS. 15 and 16). In a further alternative, another Δ-shaped barrier 10" may be assembled using modules with one panel (the forward panel 28') in a long orientation and the other (the rear panel 26') in a short orientation connecting at a mid-point along the length of the forward panel 28'. In this arrangement, additional panels may be connected between adjacent modules as the rear panels 26' may extend beyond the edge of the forward panels 28'. Again, the membrane 16 is laid over the forward panel 28' to prevent ingress of the flood water 18.

In these arrangements, any suitable means for attaching the waterproof membrane 16 may be used. For example, a clamping arrangement may be used that pierces through the membrane 16 and seals against it, similar to of the attachment point 26. Alternatively, an edge of the membrane 26 may be perforated to allow connection to the top of the barrier 10', 10".

The invention claimed is:

1. A water barrier comprising:

a water-permeable frame formed from a plurality of discrete, perforated panels, the plurality of perforated panels comprising a plurality of wall panels and a plurality of floor panels, wherein each wall panel of the plurality of wall panels comprises a plurality of protrusions for connection to a respective floor panel of the plurality of floor panels, and each floor panel of the plurality of floor panels comprises a plurality of apertures sized to receive the plurality of protrusions; and a substantially water-impermeable membrane formed separately from the water-permeable frame, wherein the water-permeable frame is configured to support the substantially water-impermeable membrane in an L-shape such that, in use, water pressure on an upper surface of a horizontal part of the water-permeable frame counter-balances water pressure on a first surface of an upright part of the water-permeable frame.

2. A water barrier according to claim 1, wherein each panel of the plurality of panels comprises a grating structure.

3. A water barrier according to claim 1, wherein the plurality of wall panels and the plurality of floor panels are configured to connect together at approximately 90° to form an L-shaped structure.

4. A water barrier according to claim 1, wherein for each wall panel of the plurality of wall panels, the plurality of protrusions permits connection of the respective wall panel to the respective floor panel at multiple locations on the face of the respective floor panel and/or facing in at least two different directions with respect to the respective floor panel.

5. A water barrier according to claim 1, wherein for each floor panel of the plurality of floor panels, the plurality of apertures permits the floor panel to connect to two or more wall panels of the plurality of wall panels.

6. A water barrier according to claim 1, wherein each wall panel of the plurality of wall panels is rectangular, having a length that is longer than its width, and wherein each wall panel of the plurality of wall panels comprises the plurality of protrusions formed along a first edge where the first edge extends in the width-wise direction, and a second plurality of protrusions formed along a second edge where the second edge extends in the length-wise direction.

7. A water barrier according to claim 1, wherein wall panels of the plurality of wall panels and floor panels of the plurality of floor panels are usable interchangeably with one another.

8. A water barrier according to claim 1, further comprising a support structure extending from the horizontal part of the water-permeable frame to the upright part of the water-permeable frame to resist deflection of the upright part of the water-permeable frame.

9. A water barrier according to claim 8, wherein the support structure extends over an upper edge of the upright part of the water-permeable frame and traps the substantially water-impermeable membrane between a cable and the upper edge of the upright part of the water-permeable frame.

10. A water barrier according to claim 9, wherein the support structure is connected at two locations to a second surface of the upright part of the water-permeable frame, opposite the first surface of the upright part of the water-permeable frame, and is connected at a point between the two locations to an attachment point on the horizontal part of the water-permeable frame.

11. A water barrier according to claim 10, wherein the attachment point clamps the substantially water-impermeable membrane against the horizontal part of the water-permeable frame.

12. A water barrier according to claim 9, wherein the support structure comprises a tensioning mechanism for applying tension to the support structure.

13. A water barrier according to claim 1, wherein the water barrier is configured to be deployed in moving water by hand and/or without the aid of machinery.

14. A kit of parts for assembling a water barrier, the kit of parts comprising:

at least one substantially water-impermeable membrane, a plurality of discrete, water-permeable panels that, when connected together, form a structural frame including a first part for supporting the at least one substantially water-impermeable membrane against horizontal water pressure and including a second part substantially perpendicular to the first part; and at least one support structure for connecting the first part and the second part to resist deflection of the structural frame, wherein the plurality of water-permeable panels comprises a plurality of first panels and a plurality of second panels;

wherein each first panel of the plurality of first panels comprises a plurality of protrusions for connection to a respective second panel of the plurality of second panels, and each second panel of the plurality of second panels comprises a plurality of apertures sized to receive the plurality of protrusions; and wherein the at least one support structure is configured to, in use, extend over an edge of the first part and trap the waterproof membrane between the at least one support structure and the edge of the first part of the structural frame.

15. A kit of parts according to claim 14, wherein each panel of the plurality of panels comprises a grating structure.

16. A kit of parts according to claim 14, wherein the plurality of protrusions and the plurality of apertures permit connection of a respective first panel of the plurality of first panels to a respective second panel of the plurality of second panels at multiple locations on a face of the respective second panel and/or facing in at least two different directions with respect to the respective second panel.

17. A kit of parts according to claim 14, wherein for each second panel of the plurality of second panels, the plurality of apertures permits two or more first panels of the plurality of first panels to connect to the second panel.

18. A kit of parts according to claim 14, wherein first panels of the plurality of first panels and second panels of the plurality of second panels are usable interchangeably with one another.

19. A kit of parts according to claim 14, further comprising at least one attachment point for connection of the at least one support structure to a panel of the of the plurality of water-permeable panels, wherein the at least one attachment point is configured to, in use, clamp the at least one waterproof membrane against the panel.

20. A kit of parts according to claim 14, wherein the at least one support structure comprises a tensioning mechanism for applying tension to the at least one support structure.

21. A kit of parts according to claim 14, wherein the kit of parts is configured to permit the water barrier assembled from the kit of parts to be deployed in moving water by hand and/or without the aid of machinery.

22. A method of assembling a water barrier from a kit of parts according to claim 14, the method comprising:

connecting water-permeable panels of the plurality of water-permeable panels to form the structural frame, wherein the structural frame is water-permeable; and covering the structural frame with the at least one substantially water-impermeable membrane, such that the structural frame supports the at least one water-impermeable membrane;

wherein the at least one support structure extends over the edge of the first part of the structural frame, and the waterproof membrane is trapped between the at least one support structure and the edge of the first part of the structural frame.

23. A method according to claim 22, wherein the water-permeable frame supports the at least one substantially water-impermeable membrane in an L-shape, such that water pressure on an upper surface of the second part of the water-permeable frame counter-balances water pressure on a first surface of the first part the water-permeable frame, and wherein the method further comprises:

connecting the at least one support structure to a second surface of the first part, opposite the first surface, and connecting the at least one support structure to an attachment point on the second part, such that the at least one support structure extends over an upper edge of the first part of the water-permeable frame and traps the at least one substantially water-impermeable membrane between the at least one support structure and the upper edge of the first part of the water-permeable frame.

24. A method according to claim 22, wherein the step of covering the structural frame with the substantially water-impermeable membrane is performed while the structural frame is at least partially submerged in water.

25. A water barrier comprising:

a water-permeable frame composed of a plurality of discrete, water-permeable panels, the plurality of water-permeable panels comprising a plurality of forward panels and a plurality of rearward panels, the plurality of water-permeable panels being arranged to form an inverted-V shape, wherein each rearward panel of the plurality of rearward panels comprises a plurality of protrusions for connection to a respective forward panel of the plurality of forward panels, and each forward panel of the plurality of forward panels comprises a plurality of apertures sized to receive the plurality of protrusions of a respective rearward panel of the plurality of rearward panels; and a substantially water-impermeable membrane formed separately from the water-permeable frame, wherein the water-permeable frame is configured to support the substantially water-impermeable membrane in a shape having a horizontal portion and a sloped portion that slopes upwardly from the horizontal portion, such that the sloped portion of the substantially water-permeable membrane is supported by the plurality of forward panels.

26. A water barrier according to claim 25, wherein each water-permeable panel of the plurality of water-permeable panels comprises a grating structure.

27. A water barrier according to claim 25, wherein the plurality of apertures is configured to permit two or more rearward panels of the plurality of rearward panels to connect to a single forward panel of the plurality of forward panels.

28. A water barrier according to claim 25, wherein the plurality of forward panels and the plurality of rearward panels are usable interchangeably with one another.

29. A water barrier according to claim 25, further comprising a support structure extending from the horizontal portion to the sloped portion to resist deflection of the sloped portion of the water-permeable frame.

30. A water barrier according to claim 25, wherein the water barrier is configured to be deployed in moving water by hand and/or without the aid of machinery.

31. A water barrier according to claim 25, wherein the plurality of forward panels and the plurality of rearward panels are configured to connect together at approximately 90° to form an L-shaped structure or a T-shaped structure.

32. A water barrier according to claim 25, wherein for each forward panel of the plurality of forward panels, the plurality of protrusions permits connection of a respective rearward panel of the plurality of rearward panels at multiple locations on a face of the forward panel.

33. A kit of parts for assembling a water barrier, the kit of parts comprising:

at least one substantially water-impermeable membrane, a plurality of discrete, water-permeable panels that, when connected together, form a structural frame including a first part for supporting the at least one substantially water-impermeable membrane against horizontal water pressure and including a second part substantially perpendicular to the first part; and at least one support structure for connecting the first part and the second part to resist deflection of the structural frame, wherein the plurality of water-permeable panels comprises a plurality of first panels and a plurality of second panels;

wherein each first panel of the plurality of first panels comprises a plurality of protrusions for connection to a respective second panel of the plurality of second panels, and each second panel of the plurality of second panels comprises a plurality of apertures sized to receive the plurality of protrusions; and wherein first panels of the plurality of first panels and second panels of the plurality of second panels are usable interchangeably with one another.

* * * * *